US008305278B2

(12) United States Patent
Corn

(10) Patent No.: US 8,305,278 B2
(45) Date of Patent: Nov. 6, 2012

(54) SATELLITE DISH HEATING SYSTEM

(76) Inventor: Mike Corn, Garden Valley, ID (US)

( * ) Notice: Subject to any disclaimer, the term of this patent is extended or adjusted under 35 U.S.C. 154(b) by 384 days.

(21) Appl. No.: 12/785,403

(22) Filed: May 21, 2010

(65) Prior Publication Data

US 2010/0295742 A1 Nov. 25, 2010

Related U.S. Application Data

(60) Provisional application No. 61/180,242, filed on May 21, 2009.

(51) Int. Cl.
*H01Q 1/02* (2006.01)

(52) U.S. Cl. ..... 343/704; 343/840; 343/872

(58) Field of Classification Search ..... 343/704, 343/840, 872, 912
See application file for complete search history.

(56) References Cited

U.S. PATENT DOCUMENTS

| | | | | |
|---|---|---|---|---|
| 4,866,452 | A | 9/1989 | Barma et al. | |
| 5,010,350 | A | 4/1991 | Lipkin et al. | |
| 5,617,107 | A | 4/1997 | Fleming | |
| 5,861,855 | A | 1/1999 | Arsenault et al. | |
| 6,100,851 | A | 8/2000 | Jones | |
| 6,195,055 | B1 | 2/2001 | Jones | |
| 2006/0250313 | A1 * | 11/2006 | Greenleaf et al. | 343/704 |

* cited by examiner

*Primary Examiner* — Anh Tran
(74) *Attorney, Agent, or Firm* — Thien Tran, Esq.; Access Patent Group, LLC

(57) ABSTRACT

A two-part satellite dish heater for de-icing or anti-snow a home satellite dish, includes a single piece of circular, notched vinyl thermoplastic sheet having a shape generally corresponding to the shape of the dish and including a cutout portion (notch) to accommodate the dish mounting structure. The dual-wire heater cable can be adhesively applied to the rear surface of a home satellite dish. The heater includes a thermostat that activates or deactivates at a lower and higher temperature setting, respectively. The temperature range can be manually changed by the user or pre-programmed by the manufacturers.

13 Claims, 3 Drawing Sheets

SATELLITE DISH HEATING SYSTEM

CROSS-REFERENCE TO RELATED APPLICATION

This application claims the benefit of Provisional Patent Application No. 61/180,242, filed on May 21, 2009, entitled "Satellite Dish Heating System", in the United States Patent & Trademark Office, the disclosure of which is incorporated herein by reference.

BACKGROUND OF THE INVENTION

Parabolic reflector antennae called "satellite dishes" have been used to communicate with orbiting satellites since about the time of the first satellite launch in the late 1950s. Interestingly, the parabolic antenna, a dish-shaped structure as used today, was first built and used in 1888 by Hertz to demonstrate the existence of electromagnetic waves theoretically predicted slightly earlier by Maxwell. More recently, since the 1980s, satellite dishes have been available for use by consumers to receive television broadcast signals. As more satellites are being launched, providing more television and other digital media broadcasts, the use of satellite dishes to receive the broadcast signals increases as well.

However, during cold weather such as during the winter seasons in both latitudes, snow and ice can accumulate on a satellite dish, thereby degrading the signal, and even sometimes completely interrupting the signal. When this happens, the snow or ice needs to be physically removed in order to obtain the "clean" signal again, e.g., by someone going outdoors to remove the accumulation. Devices for de-icing satellite dishes are known, but can vary widely according to the particular type of satellite dish that is being protected from these environmental precipitation problems.

Early home satellite dishes that communicate in the "C-Band" are generally about 2 to 6 feet in diameter and have a solid dish surface, whereas other, more special-purpose dishes can be made of a metal mesh surface. Also, newer, smaller "Ku-band" solid surface satellite dishes are being used, with a diameter of about 18 inches. This invention is directed to these home satellite dishes. This invention is primarily directed to C-band and Ku-band, solid antenna dishes.

U.S. Pat. No. 5,010,350 (Lipkin et al.) shows an anti-icing and de-icing system for reflector-type microwave antennas (i.e., "satellite dishes"), including a plurality of radiant heating elements attached to the rear surface of the antenna (see FIGS. 1-2, items 42 and 43 and column 5, lines 12-32).

U.S. Pat. No. 5,861,855 (Arsenault et al.) shows an arrangement for de-icing a satellite dish antenna including temperature-sensing, signal degrade monitoring and heater control features. More particularly, this document shows control of satellite dish heaters, in general, with smaller Ku band antenna, which are generally 18 inches in diameter, and which are generally more sensitive to signal degradation due to snow, ice or frost accumulation on the dish (for example, see top of column 3) as compared with larger C-band dishes.

U.S. Pat. No. 5,617,107 (Fleming) shows a multi-layer heated microwave antenna that can be retrofit to existing antenna installations, and includes a resistance heater grid and thermostat. In FIG. 7, a generally circular heater structure (170) with a notch is shown. The heater can be attached to the rear surface of the satellite dish using an adhesive, see the last three paragraphs of column 6. However, an additional backing plate 177 is required to be placed onto the heater structure.

U.S. Pat. No. 6,195,055 (Jones) shows a dish antenna heating assembly including a heating element (item 16, front page figure) and a plurality of cover sections (14) adhesively attached onto the heating element.

U.S. Pat. No. 4,866,452 (Barma et al.) shows a heated dish antenna including a self-regulating sheet heater.

U.S. Pat. No. 6,100,851 (Jones) shows a satellite antenna heating system including voltage measuring circuitry.

However, all of these arrangements include multi-element combinations of parts, not all being necessary, or do not provide a generally complete coverage of the rear surface of the satellite dish for nearly-total heat application, and high melting accumulation-removal efficiency. More particularly, none of these documents provide a two-piece conforming heater structure taught herein made up of a single generally circular piece of vinyl chloride ("vinyl") plastic support sheet with a serpentine-spiral heating cable attached to the support sheet. The diameter of the circular piece of plastic sheet corresponds generally to the diameter of the rear surface of the satellite dish where the heater assembly is attached, e.g., by adhesive.

Therefore, there is a need for an easy-to-attach satellite dish heater with thermostatic control to maximize de-icing and anti-icing capability during cold weather (i.e., less than 32° F.) and precipitation conditions.

BRIEF SUMMARY OF THE INVENTION AND OBJECTIVES

It is an object of the present invention to provide an automatically controlled two-piece anti-icing and de-icing heater that can be attached to the rear surface of a parabolic reflector antenna.

It is a further object to provide a two-piece heater assembly which can be set to automatically activate (heat) when the ambient temperature drops below a predetermined value, and deactivates when the ambient temperatures rises above another predetermined value, that is higher than the first value.

DETAILED DESCRIPTION

Figure 2:
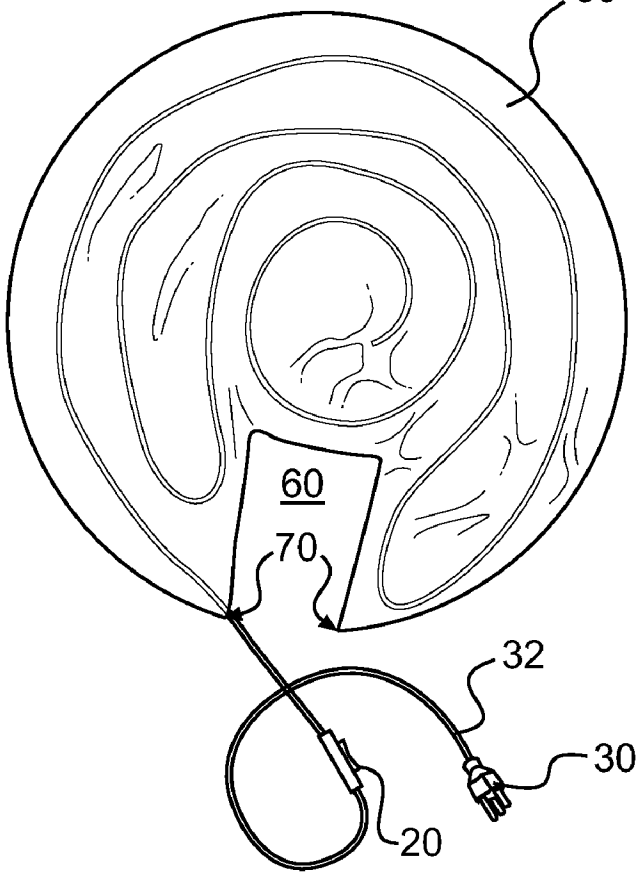
FIG. 2 shows another perspective view of the inventive heater (opposite to FIG. 1) on a flat surface with the heater cable shown in phantom.
Figure 1:
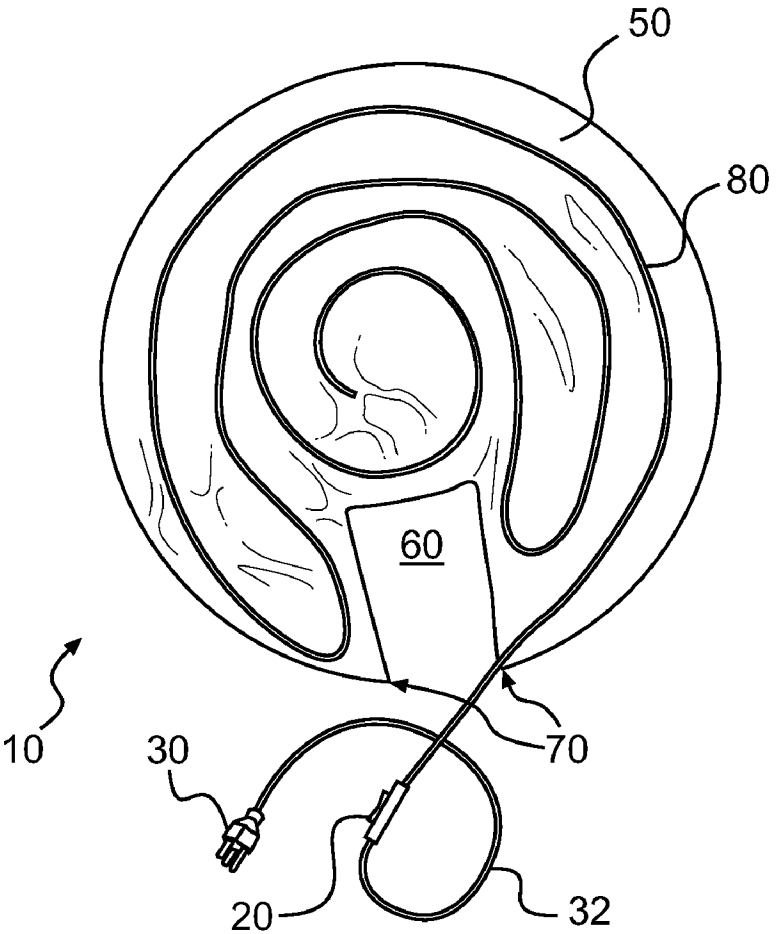
FIG. 1 shows a perspective view of the inventive heater on a flat surface.

The satellite dish heater assembly 10 is shown in perspective view in FIG. 1. A generally circularly shaped vinyl support sheet 50 having a cut-out portion or notch 60 along a portion of the sheet 50. The vinyl support sheet 50 is made of a suitable thermoplastic material, preferably polyvinylchloride (PVC or "vinyl"). The thickness of the support sheet is generally about ⅛ down to 1/32 inch, or less.

The rectangularly-shaped notch 60 has corner edges 70 where it meets the outer periphery of the sheet 50. A heater cable 80 (or "heater wire") is attached to the vinyl sheet 50, e.g., adhesively, in a generally single-loop serpentine and ending spiral geometric pattern, as shown, and extend from the sheet 50 at a corner 70 of the rectangularly-shaped notch 60. The geometrical pattern of the cable 80 on the support sheet determines the overall heat distribution of heat over the rear surface of the dish, thereby affecting efficiency of de-icing or anti-icing, etc.

The heater cable 80 ends, at one end, at the tip of the spiral at approximately the center of the vinyl sheet, and, at the other end, at an A/C outlet plug 30 (e.g., 120 V, 60 Hz for North American geographical areas). The cable can include a self-contained thermostat 20 that permits activation of the heater cable 80 (i.e., flowing current). The thermostat 20 can be on the dish or on the heater cable 80 as long as the thermostat 20 can be exposed to the ambient temperature.

Figure 5:
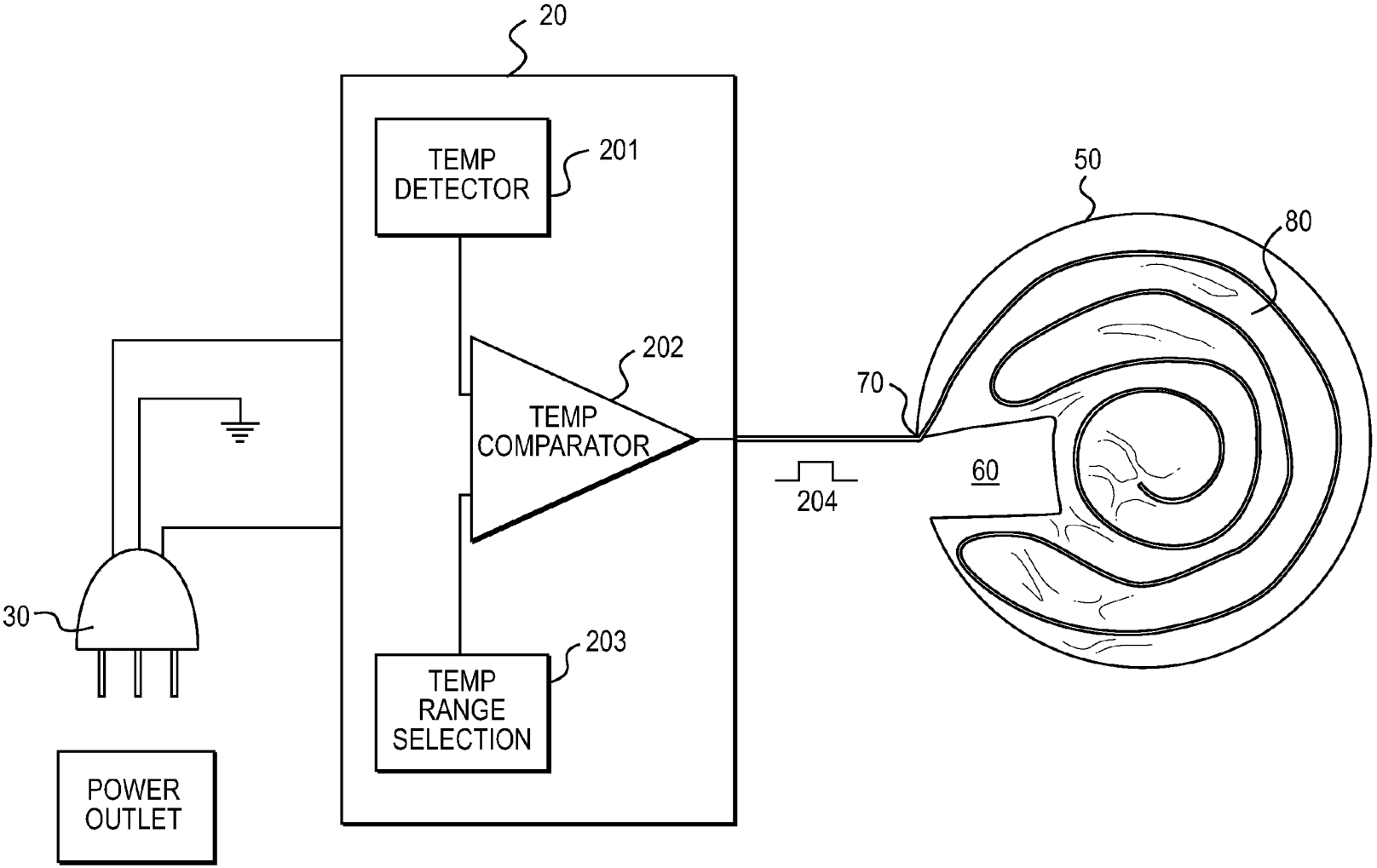
FIG. 5 shows a detailed circuitry of thermostat of the invention.

The thermostat 20 includes a temperature detector 201, a temperature comparator 202 and a temperature range selection 203 (as in FIG. 5). The user can manually select a minimum temperature 35° F. degrees and maximum temperature 45° F. degrees (a range of 10° degrees) via a knob or switch. Alternatively, the temperature range can be pre-programmed by the manufacturers. The temperature range can be selected based on the geographical location (e.g. the minimum temperature can be changed to 34° F. degrees and maximum temperature can be changed to 44° F. degrees). The thermostat 20 will send out an output voltage 204 to heat up the heater 80 if the detected temperature is below a first predetermined level (minimum temperature) and deactivation above a second predetermined value (maximum temperature), which is higher than the first value. More preferably, the thermostat 20 is set between 35° and 45° F.

The plug-end of the heater cable 80 also includes a wiring cable portion 32 with a switch (not shown) that extends from the corner edge or entry point 70 of sheet 50.

Figure 3:
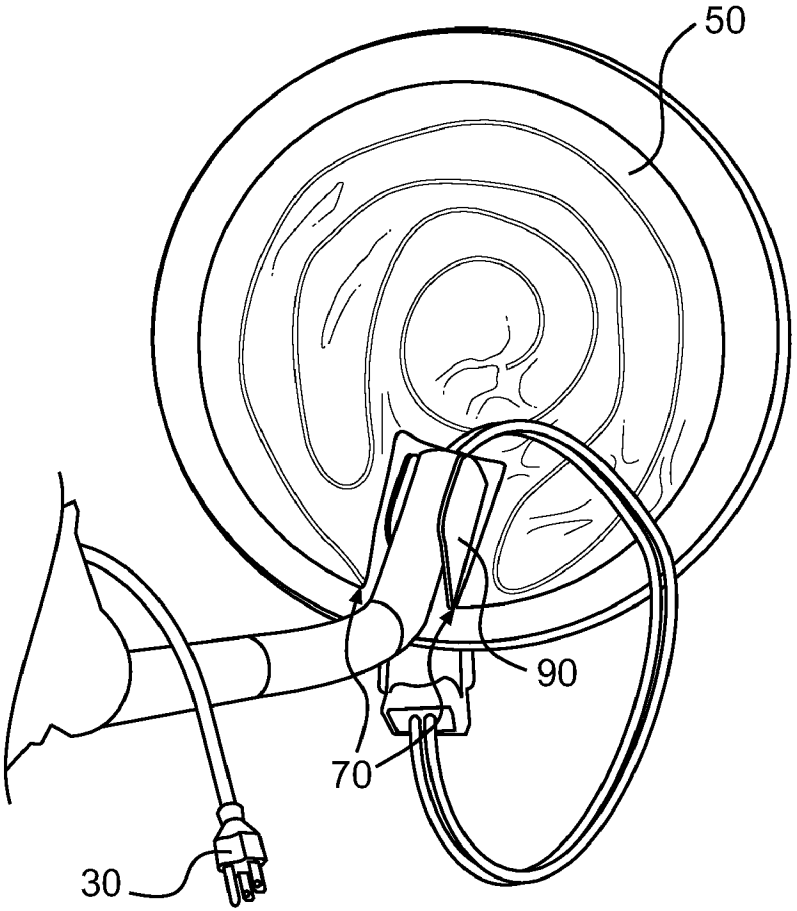
FIG. 3 shows a perspective view of the inventive heater applied to the rear of a satellite dish.

FIG. 3 shows a perspective view of the home satellite dish heater installed onto a satellite dish. The notch 60 fits around the satellite dish support mount 90. The plug 30 for the heater can be used to power the inventive heater at any available outlet. The plug 30 can have an internal light to indication the power if ON.

Figure 4:
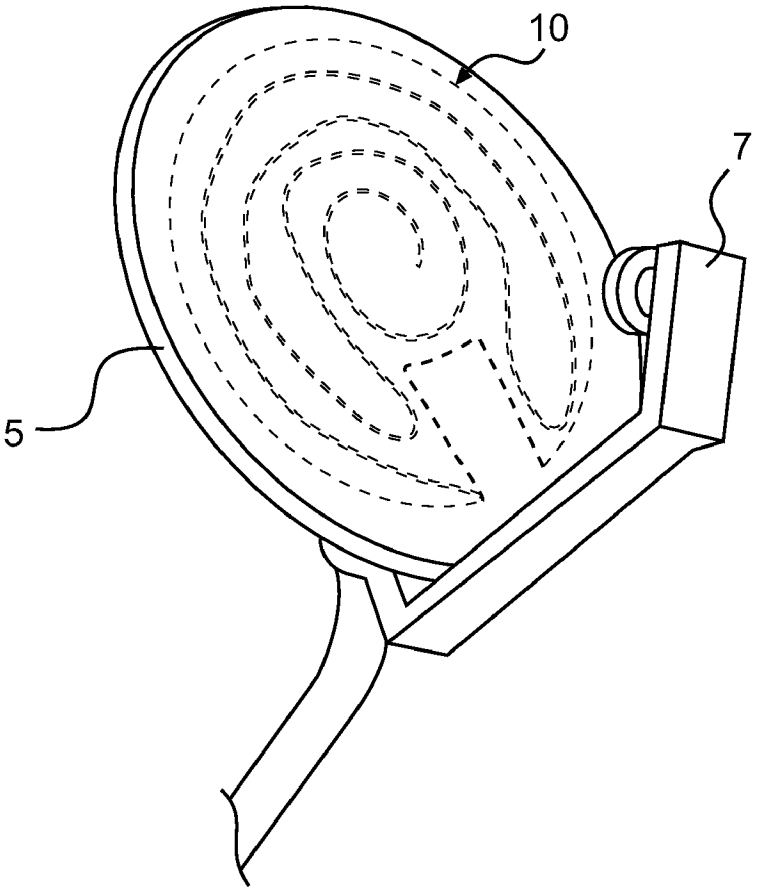
FIG. 4 shows a perspective view of a satellite dish with the heater cable in phantom.

FIG. 4 shows a home satellite dish 5, e.g., C-band or Ku-band (or comparable), with the inventive heater installed, and shown in phantom.

The heater cable 80 is a dual-wire heater cable and is utilized residential power (e.g. 120V) directly. So, the cable eliminates the use of a step-down transformer. The heater cable has scratch resistant and water-proof outer layer. The power consumption is 5 watts per feet (dry) and 8 watts per feet (wet).

The heater cable 80 can go to vinyl support sheet 50 at one single entry point 70. From entry point 70 to the end, the length of heater cable 80 is selected 3 to 4 times the perimeter of the satellite dish 50.

The invention claimed is:

1. A home satellite dish heater system comprising:

a generally circularly shaped sheet of an insulative thermoplastic material having a notch corresponding generally to the footprint of the dish mounting bracket on the rear of the dish, a heater cable attached to the circularly shaped sheet in a geometric arrangement including at least one serpentine loop covering generally uniform coverage over the rear dish surface, and ending with a spiral tip at one end, a thermostat located on the heater cable is capable of activating the heater cable when the temperature falls below a first predetermined temperature, and deactivating when the temperature rises above a second predetermined temperature, and wherein the heater cable is also attached onto the sheet in a geometric pattern that provides efficient heat distribution, whereby the dish can be maintained in an ice-free or snow-free accumulation, as a result of melting of the accumulation by the heater cable.

2. The home satellite dish heater system of claim 1, wherein, the satellite dish is a C-band or Ku-band parabolic reflector-receptor having a diameter corresponding to these microwave bands ranging 18 inches to 6 feet.

3. The home satellite dish heater system of claim 1, wherein the heater cable is attached to the sheet using an adhesive.

4. The home satellite dish heater system of claim 1, wherein the thermostat is set between 35° and 45° F.

5. The home satellite dish heater of claim 1, wherein the thermoplastic sheet is polyvinyl chloride (PVC).

6. The home satellite dish heater of claim 1, wherein the thickness of the support sheet is generally about ⅛ down to 1/32 inch.

7. The home satellite dish heater of claim 1, wherein the thermostat further includes a temperature detector, a temperature comparator and a temperature range selection.

8. The home satellite dish heater of claim 1, further allows user manually select a minimum temperature 35° F. degrees and maximum temperature 45° F. degrees (a range of 10° degrees) via a knob.

9. The home satellite dish heater of claim 1, further allows user manually select a minimum temperature 35° F. degrees and maximum temperature 45° F. degrees (a range of 10° degrees) via a switch.

10. The home satellite dish heater of claim 1, further allows the temperature range be pre-programmed by the manufacturers.

11. The home satellite dish heater of claim 1, further allows the temperature range can be selected based on the geographical location.

12. The home satellite dish heater of claim 1, wherein the length of heater cable is selected 3 to 4 times the perimeter of the satellite dish.

13. The home satellite dish heater of claim 1, where the heater cable is dual-wire heater cable.

* * * * *